United States Patent [19]

Helvenston et al.

[11] 4,264,104

[45] Apr. 28, 1981

[54] RUBBLE MINING

[75] Inventors: Edward P. Helvenston, Englewood; Byron P. Edmonds, Denver, both of Colo.; Elmar L. Goldsmith, Regina, Canada

[73] Assignee: PPG Industries Canada Ltd., Regina, Canada

[21] Appl. No.: 57,617

[22] Filed: Jul. 16, 1979

[51] Int. Cl.[3] ..... E21B 43/28

[52] U.S. Cl. ..... 299/4

[58] Field of Search ..... 299/4, 5

[56] References Cited

U.S. PATENT DOCUMENTS

| | | | |
|---|---|---|---|
| 2,161,800 | 6/1939 | Cross | 299/4 |
| 2,847,202 | 8/1958 | Pullen | 299/4 |
| 2,919,909 | 1/1960 | Rule | 299/4 |
| 3,148,000 | 9/1964 | Dahms et al. | 299/4 |
| 3,262,741 | 7/1966 | Edmonds et al. | 299/4 |
| 3,753,594 | 8/1973 | Beard | 299/4 |
| 3,779,602 | 12/1973 | Beard et al. | 299/5 |
| 3,980,339 | 9/1976 | Heald et al. | 299/4 |
| 4,017,119 | 4/1977 | Lewis | 299/4 |

*Primary Examiner*—Ernest R. Purser

*Attorney, Agent, or Firm*—Irwin M. Stein; Walter M. Benjamin

[57] ABSTRACT

The invention disclosed herein relates to solution mining soluble ore deposits by creating a cavity substantially entirely filled with a deep bed of rubble. Solvent introduced at the top of the cavity is permitted to percolate downwardly through the rubble and is withdrawn near the bottom of the cavity. More specifically, the invention relates to selective solution mining generally horizontal beds of sylvinite, i.e., a mixture of crystals of halite (NaCl) and sylvite (KCl) wherein water or salt brine is washed down a generally vertical bore hole into the deposits and recovered enriched with dissolved KCl.

8 Claims, 3 Drawing Figures

RUBBLE MINING

DESCRIPTION OF THE PRIOR ART

A large percentage of the occurrences of "potash" are natural deposits of sylvinite. Throughout this specification, unless otherwise indicated, "potash" means potassium chloride. This is consistent with the usage in the fertilizer industry of the term to cover any potassium salt, the potassium content of which is expressed as the oxide $K_2O$. Sylvinite, an association of halite (NaCl) and sylvite (KCl) is found in beds often deep below the surface. The sylvinite beds may typically comprise from 15 to 45% KCl (about 10 to 30% expressed as $K_2O$). These beds are often sandwiched between layers of more or less potash free salt. More than one bed of sylvinite separated by salt beds is common and the composition of each sylvinite bed may vary substantially from those above and below. Even within a bed, the potash content may vary from top to bottom of the bed. Within the salt and sylvinite beds are found relatively thin layers of clay and other soluble and insoluble minerals.

Of present interest are the large sylvinite deposits in Northwestern United States and Western Canada, particularly in Saskatchewan. These deposits are often 4,000 to 6,000 feet below the surface. Other potential reserves are often much deeper or much closer to the surface. The saline layer (mixed layers of sylvinite and salt) may vary in thickness from several feet to 500 feet. The sylvinite ore lies in one or more beds ranging in depth from 10 to 70 feet. The ore is often overlain with an aquifer or porous stratum containing water.

Solution mining techniques are of primary interest in exploiting these deposits due to the cost and risks of sinking a shaft through the aquifer to them. These techniques have multiple variations, for example, one or more bores may be sunk into the saline layer. Where two spaced bores are sunk, several techniques have been used to develop communication between the bottoms of the bores so that solvent may be pumped down one bore and enriched solvent recovered up through the other. In some instances, the subterranean formations may be fractured by hydraulic pressure, that is, by actually lifting the overburden and the saline deposit to create a passage at the base of the saline deposit (See for example U.S. Pat. No. 2,847,202). In extremely deep saline beds, hydraulic fracture is difficult and the communication may be established by solution mining the underlying salt deposits at the base of each bore until the cavities created thereby are joined (see U.S. Pat. No. 3,096,969). Once communication has been established, fresh water or brine is pumped down to the saline layer and back up to the surface as a brine enriched with KCl. On the surface, the KCl can be precipitated and crystallized from the brine by cooling.

It is extremely desirable to increase the KCl loading of the solvent recovered from a potash mine. To begin with, the KCl loading is dependent upon the solubilities of salt and potash in water. These are interdependent and temperature dependent. For an elucidation of the KCl-NaCl-$H_2O$ system see Kobe *Inorganic Process Industries,* pp. 60–63, The McMillan Company, New York, 1948. For any given temperature there is an invariant point composition of the mixed salt solution which is the total theoretical salt and potash loading in the presence of available undissolved NaCl and KCl.

Invarient point compositions are expressed below for selected temperatures.

| Temperature | | Invarient Composition (grams/100 grams of water) KCl | NaCl |
|---|---|---|---|
| 40° C. | (104° F.) | 20 | 29 |
| 60 | (140) | 25 | 29 |
| 80 | (176) | 30 | 28 |
| 100 | (212) | 36 | 27 |
| 120 | (248) | 41 | 27 |
| 140 | (284) | 46 | 28 |

The temperatures of the solution in the cavity being dissolved is dependent upon a number of factors including the depth of the cavity and the temperature of the water or brine being introduced from the surface. Also, the heat of dissolution of sylvite (KCl) tends to cool the salt cavity. In any event, the maximum achievable KCl loading for the common cavity temperatures is between 20 and 30 grams KCl per 100 grams of water. Quantities are predictable from the phase diagrams reflecting equilibrium conditions. As a practical matter, equilibrium conditions are not readily achieved in salt cavities for a number of reasons. In the cavity, the rate at which salt enters solution is much greater than the rate at which potash enters solution. This is due to the relative amounts present in the cavity. In common practice, the conditions in the cavity and the practical retention time of the solvent within the cavity results in recovery of a solvent which is saturated with salt and only partially saturated with KCl.

Considering the process over a number of days of operation and assuming fresh water injection, where the ratio of the salt to KCl in the deposit is greater than the ratio of the salt to KCl in the loaded brines pumped to the surface, the KCl to some degree will be selectively removed from the saline layer. With a saturated brine injection, the selectivity is complete and only KCl is dissolved from the cavity. At any given instant and location, if the solvent becomes saturated with respect to salt and not with respect to KCl, the solvent will selectively dissolve KCl. As used herein "selective mining" means a process for dissolving KCl from a sylvinite formation over some period of time without, at the same time, dissolving all of the salt associated therewith. Unfortunately, under normal solution mining conditions, selective solution mining of the KCl on the side walls of the cavity proceeds at about one-fifieth the rate of nonselective solution mining of the entire saline layer. For this reason, during principal operation of most solution mines they are operated nonselectively to enable rapid recovery of the start-up costs. After the cavities have reached a certain optium useful size they are often selectively mined thereafter by slowly pumping brine solution therethrough (see, for example, U.S. Pat. No. 3,262,741). Since only the sylvite (KCl) is removed at this time, the cavity is not enlarged. Rather a porous salt layer surrounding the cavity is formed. This enables removal of potash from the area surrounding the cavity without enlarging the cavity to the point where cave-ins resulting in surface subsidence are likely. Were it not such a slow process, any selective solution mining has several distinct advantages. It avoids creation of large underground cavities as already explained. Further, it avoids the need to dispose of large quantities of salt brine after removal of the KCl. Since the potash loading may be considerably higher for brines recovered from selective mining, the size of the cooling and crystallizing equipment for a given output can be reduced. In this event, the capital investment for the potash producer is lowered making the overall process more attractive.

Several techniques have been suggested for increasing the KCl loading of solvents pumped up from sylvinite deposits. The temperature of the solvent can be increased, thereby increasing the theoretical KCl loading of the brines. (see U.S. Pat. No. 2,161,800). While this has been suggested for sometime, it has not been commercially practical in normal cavities. Increasing the residence time of the brine in the cavity is impractical as has already been explained, due to the very slow rate of selective mining on the sidewalls of a normal cavity. Finally, it has been suggested to increase the surface area exposed to the solvent by creating a rubble pile on the floor of the cavity resulting from staged caving of the cavity roof. (See U.S. Pat. No. 3,148,000). It has also been suggested to create a rubble pile at or near the center of the cavity to channel flow of solvent along the side walls of the cavity. (See U.S. Pat. No. 2,919,909).

SUMMARY OF THE INVENTION

Briefly according to this invention, there is provided a method of solution mining of soluble ore deposit comprising a first step of drilling at least one bore hole terminating near the bottom of the ore deposit. A second step comprises solution mining through the said bore hole or holes to form a cavity in the vicinity of the bottom of the deposit. A third step comprises causing collapse of the remaining deposit into said cavity to form a deep rubble bed entirely or substantially entirely filling the cavity. A fourth step comprises solution mining by injecting solvent near the top of the rubble bed permitting the solvent to percolate downwardly through the rubble bed and withdrawing enriched solvent near the bottom of the rubble bed.

The method is particularly suitable for selective solution mining of potash deposits in which the saline deposits comprise interleaved strata relatively rich in KCl and relatively lean in KCl. In this embodiment, the bore hole or holes are drilled to terminate within a relatively lean stratum below a relatively rich stratum. A cavity is created in the relatively lean stratum by solution mining such that the top of the cavity is typically one-third (generally between one-fifth and two-fifths) of the distance from the bottom of the cavity to the top of overlying KCl rich stratum. The remaining portion of the relatively lean stratum is caused to collapse to the bottom of the cavity forming a porous trap for insolubles. Thereafter, the KCl rich stratum is caused to collapse into the cavity to form a rubble bed at least about fifteen feet deep extending from the bottom of the cavity to near the top of the KCl rich stratum providing an entirely rubble filled cavity. In order to enable withdrawal of loaded solvent from near the bottom of the rubble bed at about the zone where the KCl rich rubble abuts the salt rubble forming a porous trap, a conduit is extended from a bore hole into the rubble. Solvent unsaturated in KCl (for example, salt brine or water) introduced near the top of the rubble bed percolates downward through the rubble selectively dissolving KCl (after it is saturated with NaCl). The solvent loaded with near invarient point composition may be withdrawn from the bottom of the rubble bed.

DETAILED DESCRIPTION

Figure 3:
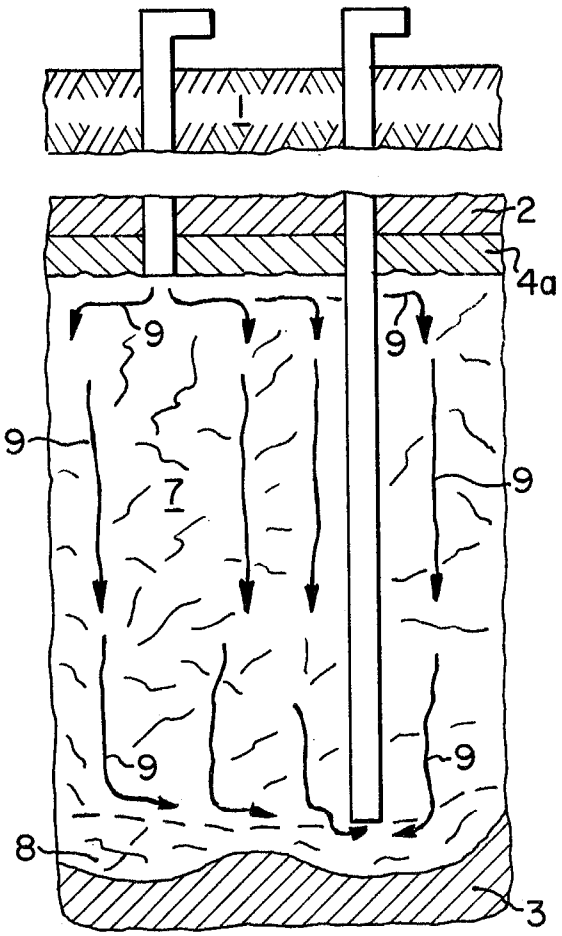
Figure 2:
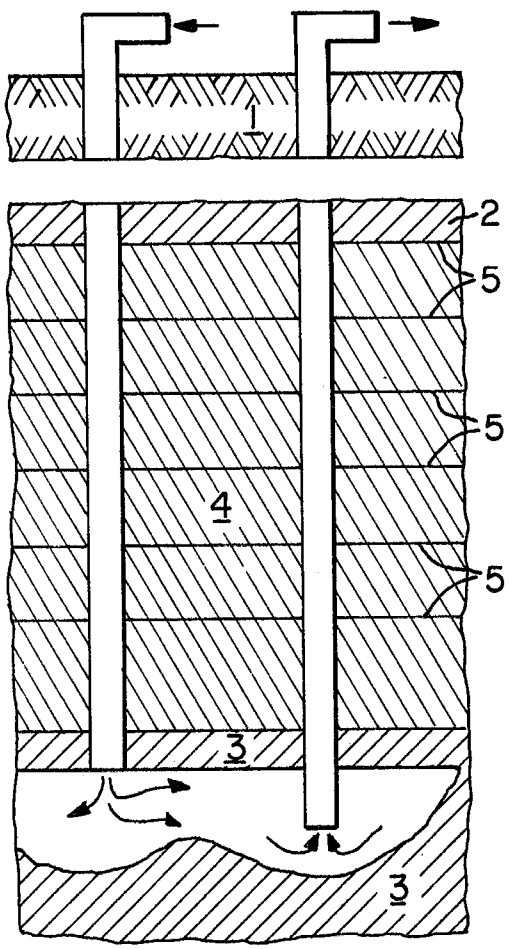
Figure 1:
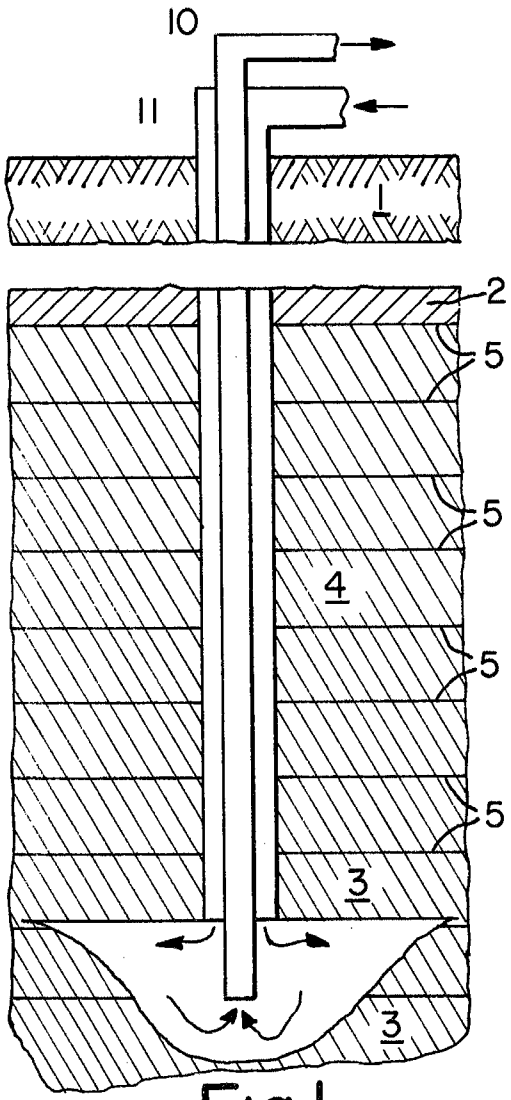

Further features and other objects and advantages of this invention will be come clear from the following detailed description made with reference to the drawings, in which FIG. 1 is a schematic illustration of a cavity being developed below a potash rich deposit, FIG. 2 illustrates a further stage in the development of the cavity below the potash rich deposit, and FIG. 3 illustrates a rubble filled cavity created by collapsing the potash rich deposit into the cavity prepared therebelow.

In the drawings, the overburden 1 is shown adjacent the surface of the earth. The overburden comprises, for example, rock and shale and may include one or more aquifer layers between the surface and the top of the saline beds. The drawings all include a break in the vertical direction between the upper portion of the overburden and a level in the saline layer. For simplicity, the saline layer is shown as an upper salt stratum 2 and a lower salt stratum 3. These have as a typical composition the following:

| | Percentage by Weight |
|---|---|
| KCl | 0 to 5 |
| Water insoluble clay | 1 to 5 |
| Calcium sulfate | about 1 to 5 |
| Calcium and magnesium water soluble salts | about 1 to 2 |
| NaCl | remainder |

In FIGS. 1 and 2, a KCl rich sylvinite layer or stratum 4 is shown sandwiched between the salt strata. This has the following typical composition

| | Percentage by Weight |
|---|---|
| KCl | 15 to 45 |
| Water insoluble clay | about 1 to 5 |
| Calcium sulfate | 1 to 5 |
| Water soluble calcium and magnesium salt | about 1 to 2 |
| NaCl | remainder |

The clay and calcium sulfate (anhydrite) in both the KCl rich and the salt strata tend to be found in bands 5. These bands define important planes of weakness as will be explained hereafter.

According to a preferred embodiment and the best mode now contemplated by the applicants, two bore holes are lowered to the saline layer and into a KCl lean (salt) stratum just below the KCl rich sylvinite stratum to be mined. The bore holes are cased and cemented in the usual manner to prevent communication between the bore hole and the clay, shale, sand and aquifers often enncountered. The distance between the bore holes is not critical and applicants have found several hundred feet to be very satisfactory. Closer together, the size of the cavity is unnecessarily reduced. Further apart, the difficulty and time taken to join the bores is increased unprofitably. Standard techniques, for example, hydrofracturing may be used to join the bore holes at their lowermost extents. In the preferred embodiment, illustrated in FIG. 1, with the use of a concentric pipe 10 within a casing 11, a cavity is washed at the base of each bore hole. Fresh water is washed down between the casing and the concentric pipe and brine is washed up the concentric pipe. The cavities develop generally conical shapes and eventually join together (FIG. 1 illustrates one of the two bore holes). The shape of the cavities washed at the base of the bore holes is controlled with a fluid pad which floats on the solvent but does not dissolve away the cavity. This technique is more specifically described in U.S. Pat. No. 3,096,969. After the cavities surrounding each bore hole communicate, the roof of the cavity is permitted to raise until the height of the cavity is typically one-third the distance from the bottom of the cavity to the top of the KCl rich stratum to be mined. Preferably, the roof is not raised to the bottom of the KCl rich stratum for reasons explained herein. The height of the cavity may vary from about one-fifth to two-fifths the distance between the base of the cavity and the top of the KCl rich stratum depending upon the practice of the following roof collapsing step. The height of the cavity depends upon the degree of packing of the rubble bed created by collapsing the remaining portion of the salt stratum and the KCl rich stratum above the cavity. For a 50 foot thick sylvinite stratum, a cavity 20 feet high in the subjacent salt stratum with a roof about 5 to 10 feet below the sylvinite stratum would be ideal where the rubble comprises about one-third interstitial volume. For a 70 foot thick sylvinite stratum, a cavity 25 feet high extending 15 feet upwards into the sylvinite stratum would be satisfactory for a similar rubble. In the latter case, potash will be mined nonselectively from the lowermost part of the stratum.

The next step is collapsing the strata over the cavity to create a rubble filled cavity. Roof callapse can be brought about in several ways, not all of which will fill the cavity with rubble. Simply enlarging the span of a salt cavity while controlling the formation of the roof of the cavity to be more or less flat and horizontal can result in incidental collapse. Reducing the hydrostatic pressure within the cavity will also cause a certain amount of roof collapse. These two collapsing mechanisms standing alone or used together will not produce a cavity substantially entirely filled with rubble unless of course, the cavity is trivially shallow, say less than 15 feet deep. According to the preferred embodiment of this invention, the roof will be collapsed by a series of inverted hydraulic fractures of the salt stratum and KCl rich stratum above the cavity which has been washed out by conventional solution mining techniques. The casing of at least one of the bore holes is preferably perforated in the vicinity of a clay band or other suitable plane of weakness in the strata. It is possible to fracture the strata in the absence of clay bands and other discontinuities but with an attendant increase in difficulty. The location of the clay bands may be determined by core samples taken during the boring or with known well logging techniques. A plug is inserted in the casing just below the perforations. The cavity may have been swabbed to reduce the pressure therein before the plug is put in place. Now pressure is applied to the plane of weakness to fracture the strata in such a way that a layer of the strata peels away falling into the cavity. It is necessary that the distance between the top of the cavity and the plane of weakness being fractured should not be too little or the roof will not peel wall-to-wall as desired. On the other hand, if the distance between the top of the cavity and the plane of weakness being fractured is too great peeling will not take place at all. The fractured strata will simply sag without falling into the cavity. An object of the fracturing and peeling is to cause the rubble bed to break into as many pieces as possible to thereby increase surface area. Hence, it may be desirable to select the distance between the top of the cavity and the plane of weakness to promote a less coarse rubble. Calculations indicate that at least a hundred-fold increase in surface area can be expected in a rubble filled cavity over the surface area of the original cavity. The calculations are based upon collapsing 65 feet of strata into a 15 foot high cavity having a minor horizontal axis of 300 feet and a major horizontal axis of 600 feet. For purposes of the calculations the rubble is assumed to be cubes at least 5 feet on edge. Smaller rubble chunks will result in even a greater increase in surface area.

The pressures applied through the perforations in the casing to the strata to cause peeling are not excessively high and can be brought about by pumping fluid into the casing above the plug. Pressures may be between 10 and 600 psi above the normal hydrostratic pressure at the level of the band. After one peel, the casing is perforated at a yet higher level adjacent yet another plane of weakness. The casing is plugged below the perforation and the peeling process repeated until the cavity is substantially entirely filled with rubble. It is contemplated that the distance between the top of the cavity and a fracture plane which will result in peeling and roof collapse into a suitable sized rubble is between 5 and 15 feet for a cavity having a 300 foot minor horizontal axis and a 600 foot major horizontal axis. Useful fracturing techniques are disclosed in U.S. Pat. No. 3,402,966 but not for the purpose of collapsing a roof.

It is an object of this invention to fill the cavity from top to bottom. The rubble extending to the very top of the cavity is especially desirable if the top is near the top of the overall saline layer and the bottom of an aquifer. The rubble thereby supports the roof of the cavity. Even as the KCl is selectively removed, the rubble will continue to support the roof preventing further caving and communication between the aquifer and the cavity.

Since the exact packing ratio for given formation can only be estimated, it is possible that before the entire stratum to be solution mined has been caved into the rubble bed, the rubble will have reached the roof preventing further caving. In this instance, nonselective mining techniques above the rubble bed can be used to raise the roof until the collapsing can be completed.

After the cavity has been filled with rubble, it is necessary to extend a conduit from one bore to near the bottom of the cavity. There are a number of ways that this may be done including use of "wash down" and "drill down" liners which can advance a conduit into a rubble pile as the rubble is dissolved or moved aside. A particularly satisfactory drill down liner is disclosed in U.S. Pat. No. 3,600,039.

Once a liner has been extended to near the bottom of the rubble filled cavity, solution mining commences as illustrated in FIG. 3. The upper portion of the rubble bed 7 comprises KCl rich rubble and the lowermost portion of the bed 8 comprises salt rubble (the KCl rich rubble and the salt rubble are separated by an imaginary dashed line in the drawing). The salt rubble at the bottom of the cavity provides a trap for insolubles, for example, clay to fall away from the solvent prior to the time it is pumped to the surface. The insolubles falling into the trap provided by the salt rubble will not blanket rubble which is rich in KCl thereby preventing the selective removal of KCl.

According to a preferred practice, a small thickness of KCl rich stratum 4a is left on the roof of the cavity. This helps in preserving the integrity of the roof. This is not essential, however, if there is sufficient salt backing the roof.

Solvent is introduced through one bore hole near the top of the cavity. It may be fresh water or it may be partially or fully saturated with salt. It may even be partially saturated with KCl. In any event, it must be at least partially unsaturated with respect to KCl. The solvent pumped into the top of the cavity will have a lower specific gravity than the solvent lower in the cavity and will thus spread out more or less horizontally over the rubble bed before beginning its downward percolation. This movement of the solvent in the bed is illustrated by arrows 9 in FIG. 3. The solvent upon entering the rubble bed will, if not already saturated with salt, quickly become saturated with salt. Thereafter, the solvent will selectively take KCl into solution with some resulting precipitation of salt from solution (recall that the solubilities in the double salt solution are interdependent). The large surface area of the rubble enables the solvent to selectively dissolve KCl at an acceptable circulation rate and the solvent will move toward the invarient point composition.

The dissolution of KCl is endothermic. Hence, as the solvent percolates downward it also cools. This, of course, will reduce the potential KCl loading and, at the same time, cause more salt precipitation. The salt precipitation may become a drawback in rubble which is not sufficiently high in sylvite (KCl) for it can form an insoluble barrier or coating over the rubble slowing or stopping the selective dissolution. Generally, if the sylvite (KCl) crystals in the sylvinite bed are all interconnected, selective solution mining is practical.

It is preferred according to this invention that solvent pumped into the cavity have a temperature higher than the loaded solvent recovered from the cavity. In this way, undue cooling of the cavity can be prevented. Due to the selectivity of the mining process described here, there is considerable advantage in increasing the temperature of the solvent injected into the cavity to even further increase the potential KCl loading and the ratio of KCl to NaCl in the solution. For example, operating at about 61° C. (142° F.) the invarient point composition is about 25.2 pounds KCl per 100 pounds of water. If the cavity were heated to 112° C. (234° F.) or the boiling point of brine at atmospheric pressures, the invarient point concentration would increase to 38.4 pounds KCl per 100 pounds of water. Since cavity pressures are considerably above the atmospheric, yet higher cavity solution temperatures are feasible.

Flow rates through the cavity are adjusted to provide the minimum retention time necessary to provide a solution loaded to the invarient point composition. It is desirable, however, that the rate of circulation not become so great that channeled flow takes place. In any event, an increase in surface area of the rubble bed over conventional cavities not only enables the obtainment of near invarient point loads but does so in a shorter retention time. Calculations indicate that the pumping rates may be increased fourfold or more over those used with conventional cavities and nonselective processes. The calculation assumptions are those set forth above for predicting surface area increase.

The process described above has been with reference to a multiple hole solution mine. It is equally applicable to single bore hole mining with concentric pipes. In that case, the inner concentric pipe must be lowered to near the bottom of the rubble bed.

The process described above was directed to mining a single KCl rich stratum. The process can be practiced with multiple strata deposits simply by repeating the rubble building process at each level.

The specific process described above was selective mining of KCl from sylvinite. It will be apparent to those skilled in the art that the generic process disclosed has applicability to nonselective mining and to mining of soluble salts other than sylvinite, for example, trona, carnallite or the like.

Having thus defined our invention with the detail and particularity required by the Patent Laws, what is desired protected by Letters Patent is set forth in the following claims.

We claim:

1. A method of solution mining an ore deposit containing potassium chloride and sodium chloride, said deposit comprising interleaved strata of deposits relatively rich in potassium chloride and deposits relatively lean in potassium chloride, comprising the steps of:

(a) forming a cavity in the vicinity of the bottom of a potassium chloride rich stratum, the top of said cavity being between one-fifth and two-fifths of the distance between the base of the cavity and the top of said potassium chloride rich stratum, (b) collapsing at least a portion of said potassium chloride rich stratum into said cavity by a plurality of hydraulic fracturing steps whereby layers of the potassium chloride rich stratum are peeled away from the top of the cavity and rubblized into a rubble bed that substantially fills the cavity, (c) selective mining the potassium chloride in the rubble bed by injecting solvent near the top of the rubble bed, thereby permitting the solvent to percolate downwardly through the rubble bed, and withdrawing solvent enriched in potassium chloride from near the bottom of the rubble bed.

2. The method of claim 1 wherein the top of the cavity is within a potassium chloride lean stratum that underlies an adjacent potassium chloride rich stratum.

3. The method of claim 2 wherein the remaining portion of the potassium chloride lean stratum above the top of the cavity is collapsed into the cavity to form a lower rubble bed.

4. The method of claim 3 wherein the solvent enriched in potassium chloride is withdrawn from near the bottom of the potassium chloride rich rubble abuting the potassium chloride lean rubble at the bottom of the cavity.

5. The method of claim 1, 3 or 4 wherein the layers of the potassium chloride strata peeled away from the top of the cavity are between 5 and 15 feet thick.

6. The method of claim 1 or 4 wherein the rubble bed of potassium chloride rich strata is at least fifteen feet deep.

7. The method of claim 1 or 2 wherein the cavity is formed by non-selective mining of potassium chloride.

8. The method of claim 1 or 4 wherein the solvent injected into the cavity is at a temperature higher than the temperature of the solvent withdrawn from the cavity.

* * * * *